United States Patent [19]

Gellenthin, Jr.

[11] Patent Number: 5,044,997

[45] Date of Patent: Sep. 3, 1991

[54] HIGH VOLTAGE ELECTRICAL CONNECTOR

[75] Inventor: Carl O. Gellenthin, Jr., Houston, Tex.

[73] Assignee: Signeon Corporation, Houston, Tex.

[21] Appl. No.: 498,790

[22] Filed: Mar. 26, 1990

[51] Int. Cl.[5] ..... H01R 4/48

[52] U.S. Cl. ..... 439/835; 439/816

[58] Field of Search ..... 439/934, 226, 816, 840, 439/935, 747, 851, 852, 853, 832, 842, 854, 856, 857, 861, 862, 324, 843, 835

[56] References Cited

U.S. PATENT DOCUMENTS

| | | | |
|---|---|---|---|
| 2,391,425 | 12/1945 | Korn | 439/843 |
| 2,549,577 | 4/1951 | Coyle | 439/843 |
| 2,666,189 | 1/1954 | Cook | 439/745 |
| 4,902,252 | 2/1990 | Whorton et al. | 439/796 |
| 4,913,661 | 4/1990 | Gellenthin, Jr. et al. | 439/438 |

FOREIGN PATENT DOCUMENTS

| | | | |
|---|---|---|---|
| 2524721 | 10/1983 | France | 439/816 |

*Primary Examiner*—David L. Pirlot
*Assistant Examiner*—Julie R. Daulton
*Attorney, Agent, or Firm*—Fulbright & Jaworski

[57] ABSTRACT

A high voltage electrical connector having a tubular glass insulator with a metal liner in the insulator. A metal connector connected to a bare end of an electrical conductor is releaseably engaged with the inside of the metal liner. The connector includes a resilient square metallic face having levers extending from opposite sides of the face for bending the face sides towards each other for release from the inside of the tubular member and for engaging and gripping the inside of the liner when the levers are released.

9 Claims, 2 Drawing Sheets

HIGH VOLTAGE ELECTRICAL CONNECTOR

BACKGROUND OF THE INVENTION

The present invention is directed to the high voltage electrical connector, and in particular, to electrical plug-in connector for connecting a high voltage conductor to an electrode such as used in the neon sign industry.

For example, as disclosed in U.S. Pat. Nos. 4,902,252 and 4,913,661, plug-in type connectors are shown for connection between a high voltage conductor wire and/or an electrode for use in a neon sign. The present invention is directed to an improved electrical connector which is simpler, less expensive, and still provides the advantages of connecting the bare end of an electrical conductor quickly, by persons without special tools or skills, and in which the connection can be disconnected and reused.

SUMMARY

The present invention is directed to a high voltage electrical connector for connecting two electrical conductors together and includes a tubular glass insulator for providing high voltage protection, a tubular electrically conductive metal liner positioned in the glass insulator, and a metal connector adapted to receive the bare end of an electrical conductor in which the connector is adapted to be releasably engaged in the inside of the metal liner. The connector includes a resilient metallic face having first and second sides, each side having first and second ends. The second ends, when the metal connector is positioned in the inside of the metal liner, resiliently engage and grip the inside of the metal liner. First and second levers are provided having first and second ends. The first ends of the first and second levers are connected to the first and second sides of the face, respectively, whereby when the second ends of the levers are pushed together the sides of the face move together and release from the inside of the metal liner.

Yet a still further object of the present invention is wherein said first and second levers are of a length to extend out of the metal liner when the metal connector is positioned in the liner.

Still a further object of the present invention is wherein the levers each include a longitudinally extending ridge for strengthening the levers.

Yet a still further object of the present invention is wherein the connector includes connection means for attaching a bare wire. The connection means may include a groove in each of the opposing edges of the face for receiving the bare end of an electrical conductor which is wrapped around the face and positioned in the grooves.

A further object of the present invention is wherein the face includes a concave cross section facing the levers for resiliently urging the face edges into a gripping engagement with the interior of the metal liner. Preferably the metallic face is generally a square.

Yet a still further object of the present invention of wherein the inside of the metal liner includes a circumferential shoulder or an opening for engagement of prongs on the metal connector.

Other and further objects, features and advantages will be apparent from the following description of presently preferred embodiments of the invention, giving for the purpose of disclosure, and taken in conjunction with the accompanying drawings.

DESCRIPTION OF THE PREFERRED EMBODIMENT

Figure 1:
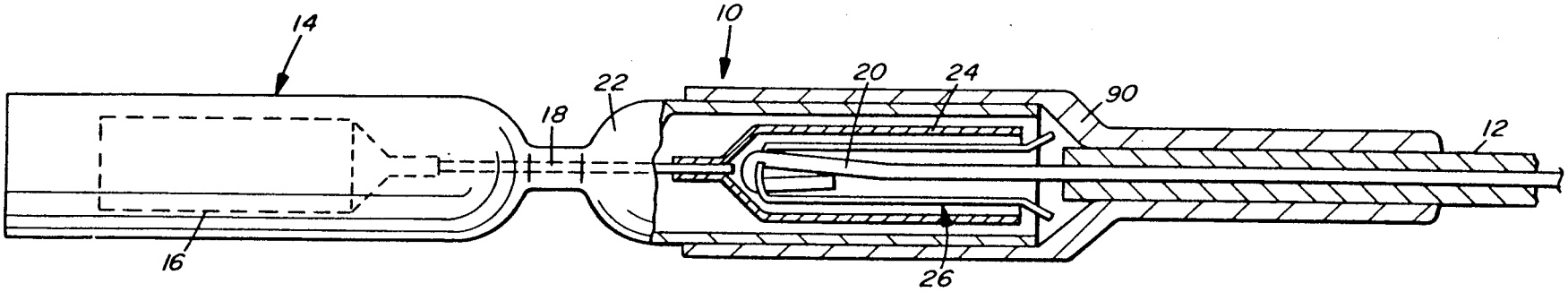
FIG. 1 is a cross-sectional elevational view, partly in cross section, of the apparatus of the present invention.

While the present invention will be described, for purposes of illustration only, as a high voltage electrical plug-in connector for connecting a high voltage conductor to an electrode used in a neon sign, the present invention is also applicable to a quick connect and disconnect for other electrical conductors.

Referring now to the drawings, particularly to FIGS. 1-4, the reference numeral 10 generally indicates the high voltage neon electrode with the plug-in connector of the present invention for connecting an electrical conductor 12 to a conventional neon electrode 14. The neon electrode 14 is a standard 15 mm electrode with a ceramic tipped 15P shell 16 connected to a suitable electrical wire or rod 18 such as a durmet. The present connector then allows the connection between the conductor 12 and the neon electrode 14 to be made manually and without any tools after the end of the conductor 12 has been stripped back to provide a bare end 20.

The connector 10 generally includes a standard neon electrode 14, a glass tubing 22, a tubular metal liner 24, and a metal connector generally indicated by the referenced numeral 26.

The glass tubing 22 houses the standard neon electrode 16, the electrical wire or rod 18, and forms the housing in which the metal liner 24 is positioned. The electrode wire or rod 18 is electrically connected to the metal liner 24 to provide an electrical connection between the liner 24 and the neon shell 16. The glass tubing will house and enclose all of the electrical connections and will provide necessary insulation to withstand the high voltage connections normally existing in neon signs, such as 6,000-15,000 volts and 20-120 milliamp currents.

In FIGS. 1-4 the metal connector 26 is adapted to receive the bare end 20 of the electrical conductor 12 and the connector 26 is adapted to be releasably engaged in the inside of the metal liner 24.

The electrically conductive metal liner 24 is tubular and includes a circular inside 30. The metal connector 26 includes a resilient metallic face 32 which is preferably generally a square. The face 32 includes a first 34 and a second 36 sides, each side having first and second ends. Thus, side 34 has ends 38 and 40 and side includes ends 42 and 44. That is, the square face 34 provides ends 38, 40, 42 and 44 which act as gripping teeth to engage and grip the interior 30 of the tubular liner 24. That is, when the connector 26 is positioned in the inside of the metal liner 24 the ends 38, 40, 42 and 44 are resiliently urged outwardly by the resilient face 32 to engage the inside 30 of the liner 24 and provide a releasable lock as well as an electrical connection.

A first lever 46 having a first end 48 and a second end 50 is provided with the first end 48 connected to the first side 34 of the face 32. A second lever 52 having a first end 54 and a second end 56 is provided with the first end 54 being connected to the side 36 of the face 32. When the ends 50 and 56 are depressed towards each other, the levers 46 and 52 bend the resilient face 32 causing the sides 34 and 36 to move towards each other thereby retracting the gripping ends 38, 40, 42 and 44 from the interior wall 30 of the liner 24. In one embodiment the inward movement of the sides 34 and 36 is approximately 0.005 inches, but this is sufficient to allow the connector 26 to be inserted into the liner 24 in a retracted position, expanded and gripped the inside of the liner 24 in a locking relationship. The edges of the levers 46 and 52 may also provide an electrical contact with interior 30 of liner 24.

If desired, a small (for example, 0.003 inches) circular ridge 60 may be provided on the interior wall 30 of the liner 24 to provide a shoulder for engagement by the metal connector 26 although such shoulder nlay be omitted.

Figure 2:
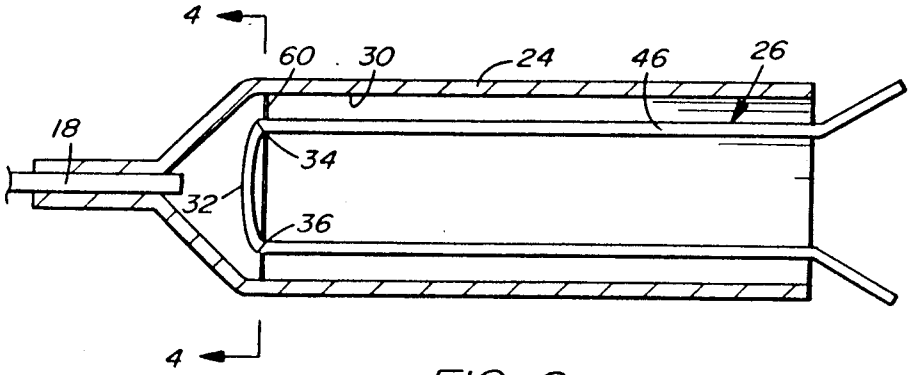
FIG. 2 is an enlarged cross-sectional schematic elevational view illustrating the releasable connection of the present invention.

Referring to FIGS. 1 and 2, it is noted that it is preferable that the first and second levers 46 and 52 are of a length to extend out of the metal liner 24 when the connector 26 is positioned in the liner of 24 to provide easy access to the second ends 50 and 56 for actuation of the levers 46 and 52. If desired, the second ends 50 and 56 may be bent outwardly for ease of access and positioning of the connector 26 in the liner 24.

Preferably, the face 32 includes a concave cross-section facing the levers 26 and 52 for providing a greater resilient force acting against the inside 30 of the liner 24.

Preferably, the connector 26 includes connection means for attaching the bare end 20 of the electrical conductor 12. For example, a hole 61 or 62 may be provided for making a solder attachment or a ring 64 may be provided for making a crimp attachment of the bare wire 20 to the connector 26.

Figure 4:
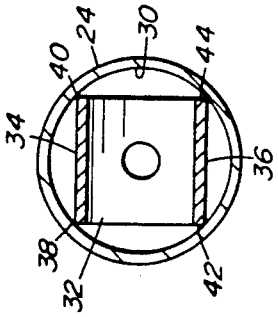
FIG. 4 is a cross-sectional view taken along the line 4—4 of FIG. 2.
Figure 3:
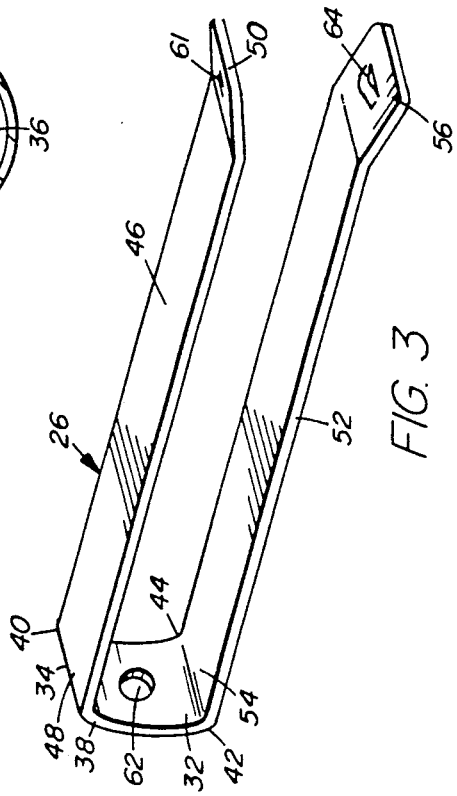
FIG. 3 is a perspective view of one embodiment of the connector of the present invention.
Figure 6:
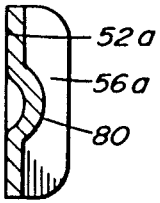
FIG. 6 is a cross-sectional view taken along the line 6—6 of FIG. 5.
Figure 8:
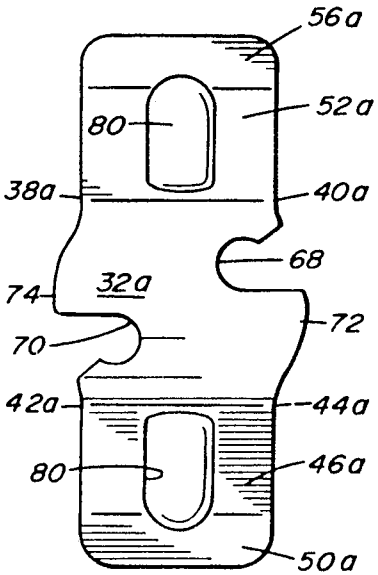
FIG. 8 is a view taken along the line 8—8 of FIG. 7.
Figure 5:
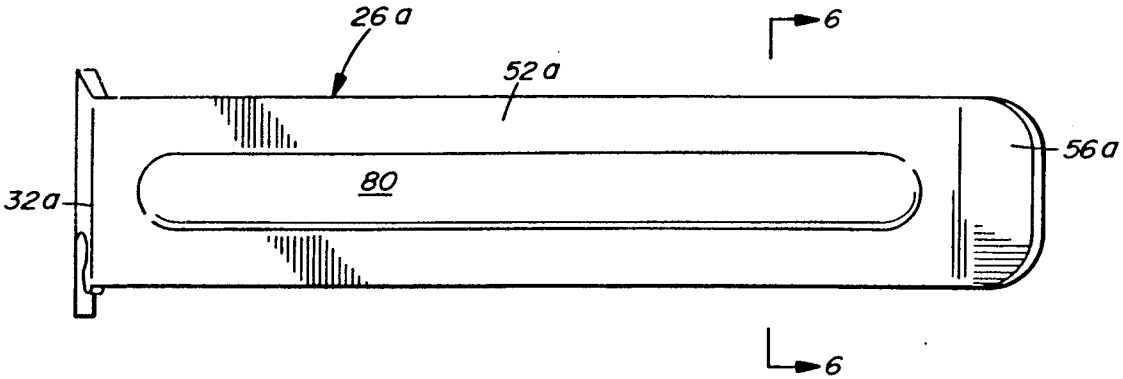
FIG. 5 is a side elevational view of the preferred form of the connector of the present invention.
Figure 7:
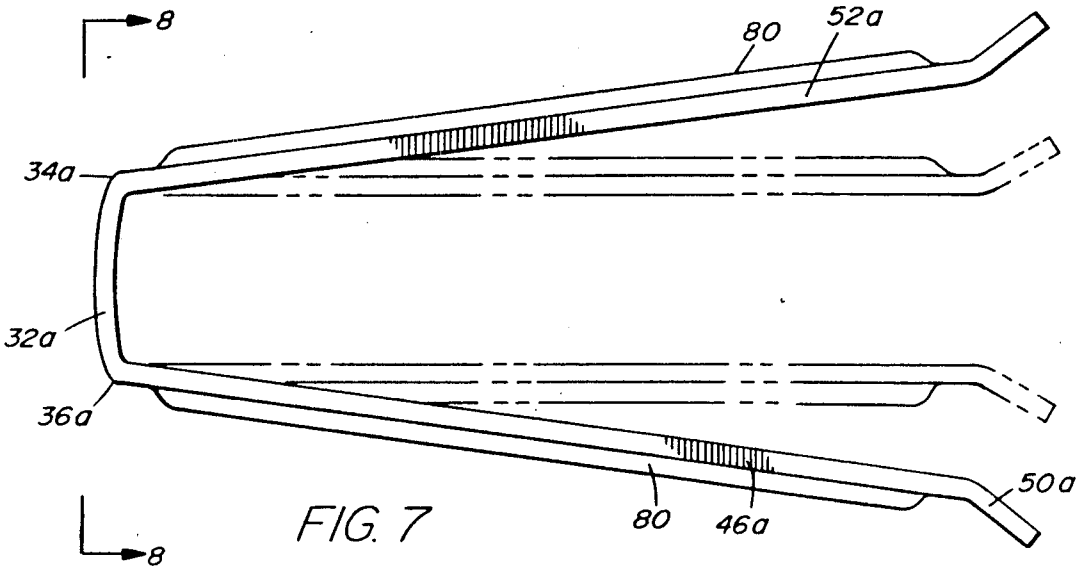
FIG. 7 is an end elevational view of the device of FIG. 5.

While the description and explanation of the connector 26 in FIGS. 2-4 describes one form of connector 26, the preferred embodiment of the connector 26 is best seen in FIGS. 5, 6 and 7, wherein like parts to those described in connection with FIGS. 2-4 will be similarly numbered with the addition of the suffix "a".

While the preferred embodiment **26*a* has a face 32*a* which is generally square for providing the gripping ends 38*a*, 40*a*, 42*a* and 44*a*, the face 32*a* may in addition include slight extensions on both edges 72 and 74 or providing grooves 68 and 70 and each of the opposing edges for receiving the bare end 20 of the electrical conductor 12 for making a secure, but easily and quickly manually performed connection. It is to be noted that the edges 72 and 74 do not extend outwardly far enough to engage with and interfere with the interior wall 30 of the metal liner 24**.

In addition, in the preferred embodiment **26*a*, each of the levers 46*a* and 52*a* include a longitudinally extending ridge 80 for strengthening the levers 46*a* and 52*a* and insuring that when the ends 50*a* and 56*a* are depressed (as best shown in dotted outline in FIG. 7), the sides 34*a* and 36*a*** are moved towards each other.

A dielectric boot 90 is provided (FIG. 1) to cover the connection thereby isolating the electrical contacts from ground and providing a weatherproof chamber.

The present invention provides for the quick and easy connection of the electrical conductor 12 to the electrode 14 of a neon lamp. The present invention is efficient, economical, meets the criteria of codes and testing authorities and may be quickly and manually connected and disconnected without the use of tools.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will be readily apparent to those skilled in the art and which are encompassed within the spirit of the invention and the scope of the appended claims:

What is claimed is:

1. A high voltage electrical connector for connecting two electrical conductors together comprising, a tubular glass insulator for providing high voltage protection, a tubular electrically conductive metal liner positioned in the glass insulator, a metal connector adapted to receive a bare end of an electrical conductor, said metal connector adapted to be releasably engaged in the inside of the metal liner of said electrical connector, including, a resilient metallic face having first and second sides, each side having first and second ends, said ends, when the metal connector is positioned in the inside of the metal liner, resiliently engage and grip the inside of the metal liner, first and second levers having first and second ends being connected to said first and second sides of the face, respectively, whereby when the second ends of the levers are pushed together the sides of the face move together and release from the inside of the metal liner.

2. The apparatus of claim 1 wherein said first and second levers are of a length to extend out of the metal liner when the metal connector is positioned in the liner.

3. The apparatus of claim 1 wherein the levers each include a longitudinally extending ridge for strengthening said levers.

4. The apparatus of claim 1 wherein the face includes a concave cross-section facing the levers.

5. The apparatus of claim 1 wherein the inside of the metal liner includes a circumferential shoulder for engagement by the metal connector.

6. The apparatus of claim 1 wherein the metallic face is generally a square.

7. The apparatus of claim 1 wherein the metal connector includes connection means for attaching a wire.

8. The apparatus of claim 7 wherein the face includes opposing edges and the connection means includes a groove in each of the opposing edges for receiving the bare end of an electrical conductor around the face and in the grooves.

9. A high voltage electrical connector for connecting an electrical conductor to a neon electrode comprising:

a tubular glass insulator for providing high voltage protection, a tubular electrically conductive metal liner positioned in the glass insulator, a metal connector adapted to receive a bare end of an electrical conductor, said metal connector adapted to be releasably engaged in the inside of the metal liner, said metal connector including, a resilient generally square metallic face having first and second sides, each side having first and second ends, said ends, when the metal connector is positioned in the inside of the metal liner resiliently engage and grip the inside of the metal liner, first and second levers having first and second ends, the first ends being connected to said first and second sides of the face, respectively, and the second ends of the levers extending out of the metal liner when the metal connector is positioned in the liner, whereby when the second ends of the levers are pushed together the sides of the face move together and release from the inside of the metal liner, and each of the levers includes a longitudinally extending ridge for strengthening said levers.

* * * * *